US006418918B2

(12) United States Patent
Mammarella

(10) Patent No.: US 6,418,918 B2
(45) Date of Patent: Jul. 16, 2002

(54) POSITIVE CRANKCASE VENTILATION SYSTEM

(75) Inventor: John R. Mammarella, Windsor (CA)

(73) Assignee: Siemens Canada Limited, Tilbury (CA)

( * ) Notice: Subject to any disclaimer, the term of this patent is extended or adjusted under 35 U.S.C. 154(b) by 0 days.

(21) Appl. No.: 09/915,851

(22) Filed: Jul. 26, 2001

Related U.S. Application Data

(63) Continuation of application No. 09/684,277, filed on Oct. 6, 2000.
(60) Provisional application No. 60/158,180, filed on Oct. 7, 1999.

(51) Int. Cl.[7] ..... F01M 13/00
(52) U.S. Cl. ..... 123/572; 123/573; 123/574
(58) Field of Search ..... 123/572, 573, 123/574

(56) References Cited

U.S. PATENT DOCUMENTS

| | | | | |
|---|---|---|---|---|
| 3,225,753 A | | 12/1965 | Bintz | |
| 4,056,085 A | | 11/1977 | Nowroski et al. | |
| 4,653,457 A | | 3/1987 | Stege | |
| 4,856,486 A | * | 8/1989 | Furuya | 123/574 |
| 4,861,359 A | | 8/1989 | Tettman | |
| 4,993,517 A | | 2/1991 | Leipelt et al. | |
| 5,090,393 A | | 2/1992 | Holch | |
| 5,113,836 A | | 5/1992 | Sweeten | |
| 5,335,641 A | * | 8/1994 | Schnabel | 123/574 |
| 5,477,819 A | | 12/1995 | Kopec | |
| 5,586,541 A | | 12/1996 | Tsai | |
| 5,697,351 A | | 12/1997 | Schumacher | |
| 6,009,863 A | * | 1/2000 | Tochizawa | 123/572 |

FOREIGN PATENT DOCUMENTS

| | | |
|---|---|---|
| DE | 4229408 | 8/1993 |
| EP | 0432012 | 6/1991 |

* cited by examiner

*Primary Examiner*—Marguerite McMahon

(57) ABSTRACT

An intake manifold for an engine is provided that includes a housing having a passageway carrying blow-by gases from an engine crankcase. A valve body housing having a cavity is defined by a portion of the housing. The valve body housing has a vacuum side and a blow-by gas side. The blow-by gas side is in fluid communication with the passageway. A positive crankcase ventilation valve is disposed within the cavity and permits the blow-by gases to flow from the passageway through to the vacuum side when in an open position. A cap is preferably secured to the housing for sealing the positive crankcase ventilation valve within the cavity. Preferably an oil separator is also integrated into the intake manifold to separate the oil from the blow-by gases.

6 Claims, 2 Drawing Sheets

POSITIVE CRANKCASE VENTILATION SYSTEM

The present application is a continuation of U.S. patent application Ser. No. 09/684,277, filed Oct. 6, 2000, which claims priority to U.S. Provisional Patent Application Ser. No. 60/158,180, filed Oct. 7, 1999.

BACKGROUND OF THE INVENTION

This invention relates to a positive crankcase ventilation system, more particularly, the invention relates to a positive crankcase ventilation system for integration into a intake manifold assembly.

An air/flue mixture is delivered to a combustion chamber of an internal combustion engine by an intake manifold assembly. The air/fuel mixture is ignited in the combustion chamber thereby forcing the piston down and generating rotary motion through a crankshaft. Piston rings create a seal between the piston and the wall of the combustion chamber to prevent combustion gases from entering the crankcase of the engine block. Additionally, the piston rings prevent oil in the engine crankcase from entering the combustion side of the combustion chamber. However, due to the high gas forces generated during the combustion process, some combustion gases "blow by" the piston rings and enter the crankcase.

It is undesirable for combustion gases to enter the crankcase because the pressure in the crankcase is raised and the combustion gases mix with the oil and degrade the oil. Accordingly, crankcase ventilation systems are used to vent the combustion gases from the crankcase. Modem crankcase ventilation systems re-circulate the gas to the intake manifold where it may be delivered to the combustion chamber for combustion. Crankcase ventilation systems incorporate a positive crankcase ventilation (PCV) valve that is typically received in the opening of a rocker cover. A hose is routed from the PCV valve to a vacuum source in the intake manifold, which draws the scavenged gases from the crankcase to the combustion chamber. The rocker cover typically includes a separator having baffles that separates the gases and oil mist. The PCV valve is vacuum actuated to permit scavenged gases to enter the intake manifold when the introduction of the gases will least negatively impact engine performance.

The location of the PCV valve external to the engine and the use of hoses to route the scavenged gases to the intake manifold may permit the scavenged gases to leak from the positive crankcase ventilation system thereby generating unacceptable emissions. This is of great concern with strict emissions requirements common today. Accordingly, what is needed is a positive crankcase ventilation system that is located within an engine component and eliminates the use of hoses to reduce the possibility of unwanted emissions.

SUMMARY OF THE INVENTION AND ADVANTAGES

The present invention provides an intake manifold for an engine including a housing having a passageway carrying blow-by gases from an engine crankcase. A valve body housing having a cavity is defined by a portion of the housing. The valve body housing has a vacuum side and a blow-by gas side. The blow-by gas side is in fluid communication with the passageway. A positive crankcase ventilation valve is disposed within the cavity and permits the blow-by gases to flow from the passageway through to the vacuum side when in an open position. A cap is preferably secured to the housing for sealing the positive crankcase ventilation valve within the cavity. Preferably, an oil separator is also integrated into the intake manifold to separate the oil from the blow-by gases.

Accordingly, the present invention provides a positive crankcase ventilation system that is located within an engine component and eliminates the use of hoses to reduce the possibility of unwanted emissions.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENT

Figure 1:
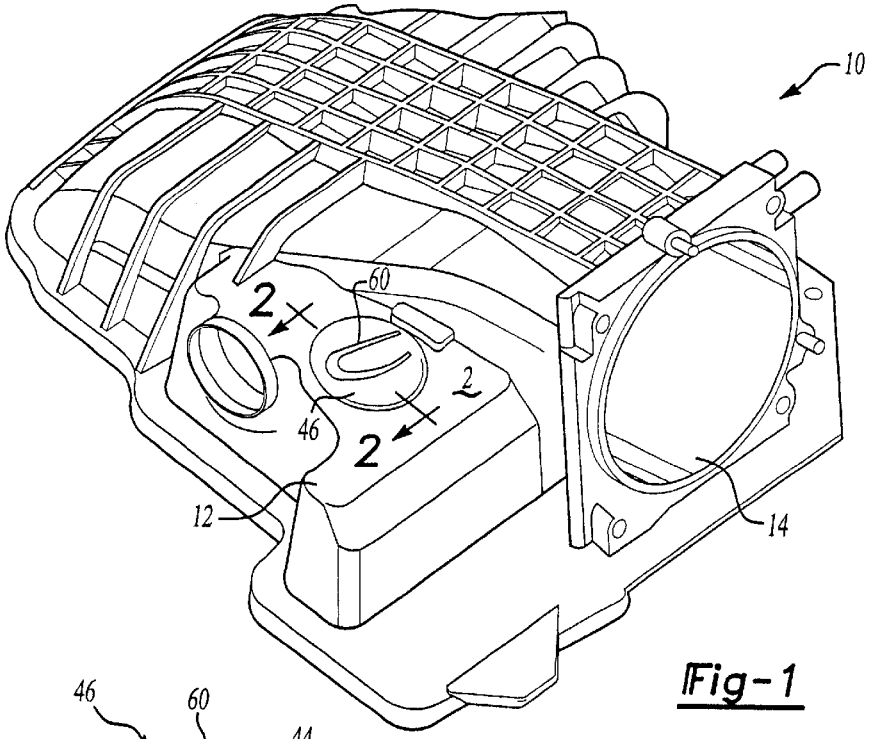
FIG. 1 is a perspective view of a portion of another intake manifold with the present invention PCV system.

A portion of intake manifold 10 is shown in FIG. 1. The intake manifold 10 is defined by housing 12 and is preferably constructed from a material such as plastic. The intake manifold 10 includes an intake opening 14 to which a throttle body (not shown) is secured. The intake manifold 10 delivers an air/fuel mixture to the combustion chamber of the engine.

Figure 2:
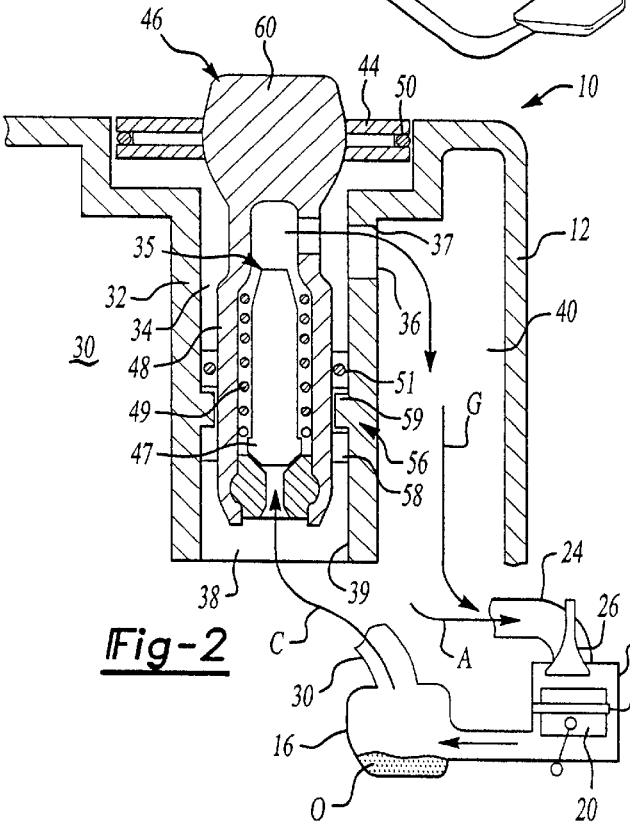
FIG. 2 is a cross-sectional view of the PCV system shown in FIG. 1 taken along line 2—2.

Portions of an engine are schematically shown in FIG. 2. An engine includes a crankcase 16 that has a combustion chamber 18 with a piston 20 that moves up and down in the combustion chamber. The intake manifold 10 includes an intake runner 24 that defines an air supply passage which delivers the air/fuel mixture to the combustion chamber 18. An intake valve 26 opens and closes to permit the air/fuel mixture A to enter the combustion chamber 18. Piston rings 22 are arranged between the piston 20 and the combustion chamber 18 to prevent combustion gases from entering the crankcase 16. However, some combustion gases do blow by the piston rings 22 and enter the crankcase 16 where the combustion gases C mix with the oil O. The present invention includes a passageway 30 defined in the housing 12 of the intake manifold assembly 10 to route the combustion gases C to the positive crankcase ventilation system.

The intake manifold assembly 10 includes a valve body housing 32 defined by a portion of the housing 12, which defines the cavity 34. A PCV valve assembly 35 is arranged in the cavity 34. The valve body housing 32 has a blow by side 38 in fluid communication with the passageway 30. The valve body housing 32 has a vacuum side 36 that is in fluid communication with a scavenged gas passageway 40. Openings 37 and 39 are formed in the valve body housing 32 to permit gases to flow through the cavity 34. In operation, the combustion gases C flow from the passageway 30 in the intake manifold 10 to the blow by side 38 of the valve body housing 32 and into the opening 39. When the PCV valve assembly 35 is in an open position, the combustion gases C are permitted to flow through the PCV valve and through the opening 37 on the vacuum side 36 into the scavenged gas passage. The gases G flow from the scavenged gas passage 40 back to the intake runner 24 where it may then enter the combustion chamber 18 for reuse. Preferably, the passageway 30 and the scavenged gas passage 40 are integrally formed by the housing 12 of the intake manifold 10 to eliminate any external hoses.

The PCV valve assembly 35 includes a valve 47 that is bias closed by a spring 49. The PCV valve 47 is shown in a closed position. The valve 47 is opened by a vacuum source applied to the vacuum side 36 of the valve body housing 32.

Figure 3:
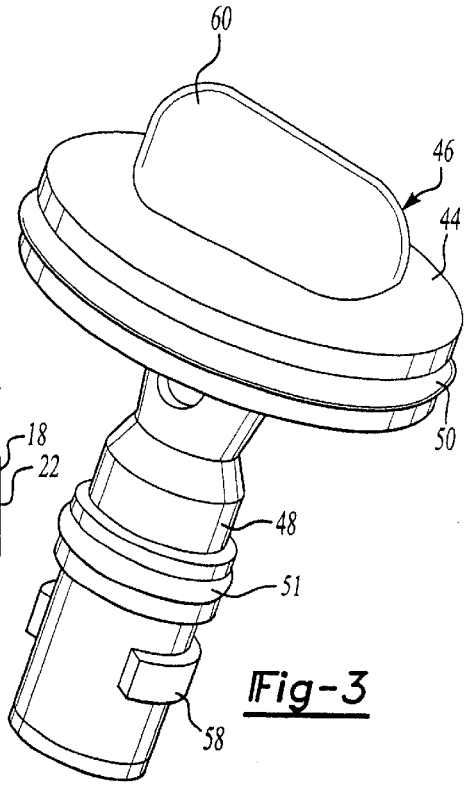
FIG. 3 is a perspective view of the PCV valve shown in FIG. 1.

It is also preferable that the PCV valve assembly 35 of the present invention be sealed in the intake manifold 10 by a cap 44. In one embodiment, shown in FIGS. 2 and 3, a disposable cartridge 46 includes the PCV valve assembly. The cartridge 46 has a body 48 with the valve 47 and spring 49 disposed therein. The cap 44 is integrally formed with the body 48 of the cartridge 46. Seals 50 and 51 are arranged between the cartridge 46 and the valve body housing 32 to prevent combustion gas emissions from exiting the intake manifold 10. Preferably, the cartridge 46 is secured to the housing 12 by an interlocking assembly 56 that includes tabs 58 extending from the body 48 and protrusions 59 extending from the valve body housing 32. The cap 44 includes a handle 60 extending therefrom. The body 48 of the cartridge 46 is inserted into the cavity 34 and rotated about its axis relative to the valve body housing 32 to lock the cartridge 46 to the housing 12. In this manner, a tamper proof PCV valve assembly is provided.

Figure 4:
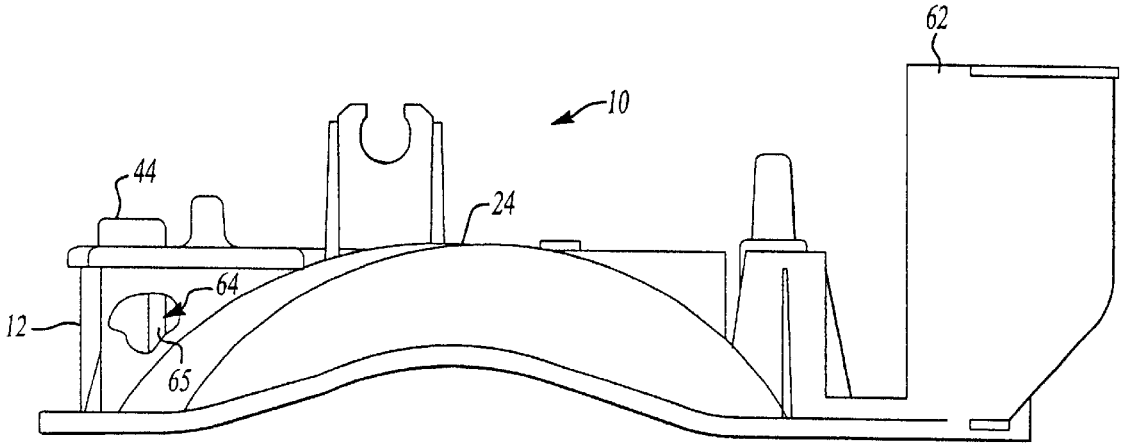
FIG. 4 is a front elevational view of an intake manifold incorporating the present invention PCV system.
Figure 5:
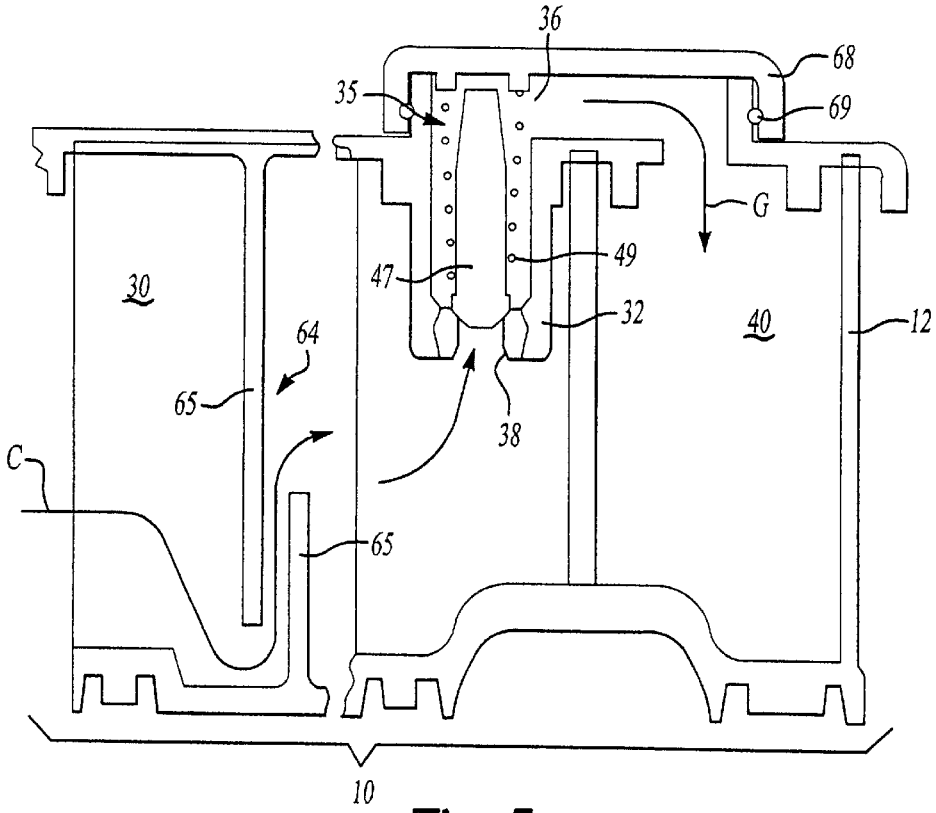
FIG. 5 is a cross-sectional view of the PCV system of the present invention taken of FIG. 4.

Another intake manifold 10 is shown in FIGS. 4 and 5. The intake manifold 10 includes an oil fill 62 integrated therewith. Oil may be poured into the oil fill 62 where it is then delivered to a cylinder head or engine block. The intake manifold 10 may also include a separator 64 having walls 65 or baffles for separating the oil mist from the combustion gases. The combustion gases may then be routed through the PCV valve assembly for delivery to the combustion chamber for reuse. Referring to FIG. 5, the PCV valve assembly 35 may be enclosed by a cap 68 that is sealed to the housing 12 by welding or a snap fit and rubber seal 69. To eliminate parts, the valve 47 and spring 49 may be received directly by the valve body housing 32.

The present invention eliminates hoses used in the prior art and encloses the PCV valve assembly into an engine component such as the intake manifold to prevent leakage of combustion gases thereby reducing the possibility of undesirable emissions.

The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. An intake manifold for an engine comprising:

a manifold housing having a passageway for carrying blow-by gases from an engine crankcase;

a valve body housing having a cavity defined by a portion of said manifold housing, said valve body housing having vacuum and blow-by gas sides with said blow-by gas side in fluid communication with said passageway;

a positive crankcase ventilation valve disposed within said cavity permitting the blow-by gases to flow from said passageway through to said vacuum side when in an open position; and a cap secured to said manifold housing for scaling said positive crankcase ventilation valve within said cavity with said cap attached to said manifold housing over said valve body housing, said cap retaining said positive crankcase ventilation valve within said cavity.

2. The intake manifold according to claim 1, wherein said cap is welded to said manifold housing over said positive crankcase ventilation valve.

3. The intake manifold according to claim 1, wherein said cap is snap-fit to said manifold housing over said positive crankcase ventilation valve.

4. The intake manifold according to claim 1, wherein said positive crankcase ventilation valve includes a valve member and a biasing member urging said valve member from said open position to a closed position, said biasing member coacting with said cap to urge said valve member from said open position to said closed position.

5. An intake manifold for an engine comprising:

a manifold housing having a passageway for carrying blow-by gases form an engine crankcase, wherein said manifold housing includes an oil separator disposed in said passageway having at least one wall portion for separating oil from the blow-by gases;

a valve body housing having a cavity defined by a portion of said manifold housing, said valve body housing having vacuum and blow-by gas sides with said blow-by gas side in fluid communication with said passageway;

a positive crankcase ventilation valve disposed within said cavity permitting the blow-by gases to flow from said passageway through to said vacuum side when in an open position; and a cap secured to said manifold housing for sealing said positive crankcase ventilation valve within said cavity with said cap attached to said manifold housing over said valve body housing, said cap retaining said positive crankcase ventilation valve within said cavity.

6. An intake manifold for an engine comprising;

a manifold housing having a passageway for carrying blow-by gases from an engine crankcase, said manifold housing including an air supply passage in said manifold housing for delivering an air/fuel mixture to a combustion chamber, and a scavenged gas passage defined by another portion of said manifold housing in fluid communication with said air supply passage and said vacuum side;

a valve body housing having a cavity defined by a portion of said manifold housing, said valve body housing having vacuum and blow-by gas sides with said blow-by gas side in fluid communication with said passageway;

a positive crankcase ventilation valve disposed within said cavity permitting the blow-by gases to flow from said passageway through to said vacuum side when in an open position; and a cap secured to said manifold housing for sealing said positive crankcase ventilation valve within said cavity with said cap attached to said manifold housing over said valve body housing, said cap retaining said positive crankcase ventilation valve within said cavity.

* * * * *